US006523896B1

(12) United States Patent
Uhlenbrock

(10) Patent No.: US 6,523,896 B1
(45) Date of Patent: Feb. 25, 2003

(54) CHAIR

(75) Inventor: Johannes Uhlenbrock, Drensteinfurt (DE)

(73) Assignee: Peter Roder, Frankfurt am Main (DE)

( * ) Notice: Subject to any disclaimer, the term of this patent is extended or adjusted under 35 U.S.C. 154(b) by 41 days.

(21) Appl. No.: 09/610,469

(22) Filed: Jul. 5, 2000

(30) Foreign Application Priority Data

Jul. 6, 1999 (DE) ..... 199 31 099
May 26, 2000 (DE) ..... 100 26 292

(51) Int. Cl.[7] ..... A47C 1/024

(52) U.S. Cl. ..... 297/300.4; 297/300.5; 297/300.3; 297/301.3

(58) Field of Search ..... 297/300.9, 301.1, 297/301.4, 300.1, 300.2, 300.3, 300.4, 301.3, 303.3

(56) References Cited

U.S. PATENT DOCUMENTS 2,991,125 A * 7/1961 Lie ..... 297/300.4
3,868,144 A * 2/1975 Lie ..... 297/304
4,779,925 A * 10/1988 Heinzel ..... 297/301
4,979,778 A * 12/1990 Shields ..... 297/301
5,308,144 A * 5/1994 Korn ..... 297/301

* cited by examiner

*Primary Examiner*—Peter M. Cuomo
*Assistant Examiner*—Stephanie Harris
(74) *Attorney, Agent, or Firm*—Sonnenschein Nath & Rosenthal

(57) ABSTRACT

A chair is provided comprising a seating platform having a front edge and a back edge, a seat carrier that carries the seating platform and is connected to one of a central chair column and a plurality of chair legs, a rest carrier that proceeds toward the back under the seating platform and upward behind the seating platform, and a backrest carried on the rest carrier. The seating platform, close to its front edge, is hinged to the seat carrier pivotable around a transversely proceeding, first swivelling axis and, offset therefrom toward the back edge, is hinged to the rest carrier pivotable around a parallel, second swivelling axis. The rest carrier is hinged to the seat carrier pivotable around a third swivelling axis that is located between the first and second swivelling axis and parallel thereto. A spring is provided under the seating platform and supported thereat which exerts a pre-stress force acting upwardly on the seating platform and toward the front on the back rest. The rest carrier comprises an extension that extends forward of the third swivelling axis and forms a lever arm. The spring has its end remote from the seating platform supported on the rest carrier extension and the seating platform comprises a vertical motion latitude relative to at least one of the seat carrier and the rest carrier.

24 Claims, 7 Drawing Sheets

CHAIR

BACKGROUND OF THE INVENTION

The present invention is directed to a chair having a seating platform, having a seat carrier that carries the seating platform and is connected to a central chair column or a plurality of chair legs, and having a rest carrier that proceeds toward the back under the seating platform and upward behind the seating platform and carries a backrest, whereby the seating panel, close to its front edge, is hinged to the seat carrier pivotable around a transversely proceeding, first swivelling axis and, offset therefrom toward the back, is hinged to the rest carrier pivotable around a parallel, second swivelling axis, whereby the rest carrier is hinged to the seat carrier pivotable around a third swivelling axis that proceeds between the first and second swivelling axis and parallel thereto, and whereby a compression spring arrangement that exerts a pre-stress force acting upwardly on the seating platform and toward the front on the back rest is provided under the seating platform and is supported thereat.

DE 43 13 301 C2 discloses a chair of the type just described. It is thereby specifically provided that supports that are downwardly directed in pairs are rigidly secured to the underside of the seating platform in the front and back region thereof, whereby the lower ends of the front supports are pivotably connected to downwardly directed guide members pivotably secured to the seat carrier, and the lower ends of the rear supports are pivotably connected to the rest carrier, and that the compression spring-arrangement is arranged between the seating platform and the seat carrier. What is referred to as a synchronous mechanism is achieved with this design of the chair, whereby, when the back part of the seating platform is loaded, the platform is lowered toward the back and the backrest is simultaneously pivoted toward the back, whereby the swivel angle of the backrest is usually greater than the swivel angle of the seating platform. The relationship of the swivel angle to one another is defined by the interacting lever lengths.

What is considered disadvantageous about this known chair is that the pre-stressing force of the back rest is dependent only on the strength of the compression spring arrangement and the lever effect determined in the design of the chair, so that an adaptation of the pre-stressing force of the backrest to different body weights of different users is not possible at all. Although an influencing of the pre-stressing force of the backrest would be possible by employing an adjustable or biasable compression spring arrangement, the user of the chair must manually implement the adjustment for this purpose, which represents an undesirably high outlay, particularly when a chair is used by different users that differ in weight. Moreover, it is not assured that the user will find the suitable setting, as a result whereof settings of the pre-stressing force of the backrest can derive that are incorrect and that may even be harmful to health under certain circumstances.

SUMMARY OF THE INVENTION

An object of the present invention is therefore to create a chair of said species that avoids the disadvantages that have been presented and whereby, in particular, an automatic adaptation of the pre-stressing force of the backrest to users differing in weight is achieved.

The features of the chair that are present in a preferred embodiment of the invention are that the seating platform is moved down given use by a heavy user, this necessarily leading to a tensing of the compression spring arrangement. Since the compression spring arrangement is supported on the extension of the rest carrier, the compression spring arrangement exerts a lever moment on the rest carrier that leads to an increase in the pre-stressing force of the backrest. A chair user having a high body weight thus experiences an increased support of his or her back by the backrest, as is desired and ergonomically meaningful. When a lighter weight user sits on the chair, the seating platform assumes a position that lies further up and wherein the compression spring arrangement is tensed less; correspondingly, a slighter pre-stressing force of the backrest necessarily follows, so that a lighter weight user also experiences an appropriately lesser supporting force of the backrest against his or her back in conformity with the lower body weight. At the same time, however, the synchronous adjustment of seating platform and backrest is preserved to its full extent, so that the seating platform and the backrest are also swivelled in a predetermined relationship relative to one another given changes in the sitting position. Despite the synchronous mechanism and the automatic adaptation of the pre-stressing force of the backrest to different user body weights, the chair has a surprisingly simple design, so that the manufacture of the chair is relatively simple and cost-beneficial.

In order to achieve a compact structure that occupies little space, it is preferably provided that the second swivelling axis proceeds under the seating platform close to the longitudinal center thereof. The mechanism required for the chair movements can thus be concentrated under the front half of the seating platform, which simplifies the manufacture of the chair and which yield an attractive appearance of the chair and, in particular, of its motion mechanism arranged under the seating platform.

It is also provided that the underside of the seating platform comprises at least one respective front and back bearing support through which the first, front swivelling axis and the second, back swivelling axis proceeds. As a result of these bearing supports, the first and the second swivelling axes are lent a desired spacing from the seating platform. Moreover, different seating platforms can be connected to the bearing supports in the simplest way, so that different embodiments and designs of the chair with a different seating platform are possible with little outlay.

A technically simple and, at the same time, functionally dependable solution for achieving the aforementioned vertical motional latitude of the seating platform relative to the seat carrier and/or the rest carrier is comprised therein that the bearing supports each comprise an oblong hole through which a first, front and second, back bearing pin rigidly connected to the seat carrier respectively proceeds, whereby the oblong holes proceed on a radius around the respectively non-appertaining, other bearing pin. As a result of said course of the oblong holes, a swivelling of the seating platform both around the front, first swivelling axis as well as around the back, second swivelling axis is possible without seizing, so that the seating platform can effortlessly adapt to different sitting postures of the chair user.

It is further proposed that, for forming a motion detent of the rest carrier, the second, back bearing pin also proceeds through an essentially vertically directed oblong hole in the rest carrier. Separate means for limiting the movement of the rest carrier are eliminated in this way, this being a further contribution to the simplification of the mechanical design of the chair. At the same time, said oblong hole, in interaction with the second, back bearing pin, serves for coupling the seating platform and rest swivel within the synchronous mechanism.

One embodiment of the chair, which can be preferably employed as an office swivel chair, provides that the seat carrier, proceeding in longitudinal direction of the seating platform, is arranged thereunder in the transverse center thereof, and has its back end connected to the chair column; that a respective rest carrier having a respective, appertaining compression spring arrangement is provided to the left and right of the seat carrier and symmetrically relative thereto; that two respective, front and back bearing supports are present; and that a respective, through, front and back bearing pin is attached to the seat carrier.

An alternative embodiment of the chair, which is essentially suitable as a consultation or conference chair, is characterized in that the seat carrier is implemented bipartite and is connected to a respective chair leg arranged proceeding in longitudinal direction of the seating platform laterally to the left and right thereof and thereunder as well as at its front and back ends; that a respective rest carrier with a respective, appertaining compression spring arrangement is provided at the left and right inside of and parallel to the two seat carrier parts; that respectively two front and back bearing supports are present; and that a respective, through, front and back bearing pin is attached to the two seat carrier parts.

Said compression spring arrangement is advantageously a coil spring arrangement because coil springs require little installation space and because they are a standard component part that can be accordingly easily acquired in the greatest variety of embodiments.

Alternatively, for example, the compression spring arrangement can also be a gas compression spring arrangement or an elastomer spring arrangement instead of a coil spring arrangement.

In a further alternative, the compression spring arrangement is formed by a torsion spring arrangement.

It is provided in a further development of the aforementioned embodiment of the chair that the/each torsion spring forming the torsion spring arrangement comprises a spring member that comprises one or more turns surrounding the third swivelling axis as well as two spring legs extending tangentially outward therefrom, whereby a first spring leg is supported close to its free end at the underside of the seating platform and a second spring leg is supported at the rest carrier, and whereby the spring legs are biased such that they exert an upwardly directed force onto the seating platform and exert a force on the rest carrier that pre-stresses the backrest toward the front. What this chair advantageously achieves is that the structural height of the spring arrangement is determined only by the outside diameter of the spring member since the torsion spring has a spring member whose longitudinal axis proceeds in horizontal direction transversely under the seating platform. At the same time, the spring member embraces the third swivelling axis, so that the torsion spring is adequately reliably held under the seating platform without additional structural measures. Further, it is unproblematically possible to set the spring characteristic of the torsion spring within broad ranges as desired, whereby changes in the spring characteristic are possible by modifications of the spring strength and/or the number of turns and/or the turn diameter as well as the length of the spring legs. One advantage, finally, is also comprised therein that torsion springs are simple and commercially available spring elements that are cost-beneficial and keep the overall manufacturing costs of the chair low.

It is provided in a preferred development, that both spring legs proceed toward the front away from the spring member approximately parallel to one another, whereby the second spring leg is supported at the upper side of the extension of the rest carrier and exerts a downwardly directed force onto the extension. This alignment of the spring legs yields an especially space-saving arrangement, so that the spring arrangement requires only a slight structural height under the seating platform. This is especially advantageous for the visual appearance of the chair in its side view.

In order to keep wear phenomena and noises in the use of the chair as low as possible or even avoid them to the farthest-reaching extent, it is also proposed that at least the first spring leg lies in a glide or roll guidance connected to the seating platform.

In order to distribute the forces acting on the parts of the chair in conjunction with the spring-bearing and thereby limit them in terms of their size, it is also proposed that two torsion springs are provided symmetrically relative to the longitudinal center axis of the chair, these being preferably formed of one piece with one another on the basis of a single, correspondingly doubly coiled and bent spring steel wire or rod. Due to the one-piece implementation of the two torsion springs, moreover, a further contribution can be made to a simple mechanical design and cost-beneficial manufacture.

In another alternative, the compression spring arrangement in the chair is formed by a torsion bar spring.

It is provided in a further development of the aforementioned embodiment of the chair that the/each torsion bar spring forming the torsion bar spring arrangement is formed with at least one spring section that is loaded for torsion and proceeds in the transverse chair direction and is formed with at least two spring levers proceeding in longitudinal chair direction, whereby a first spring lever is supported close to its free end at the underside of the seating platform and a second spring lever is supported at the rest carrier, and whereby the spring levers are biased such that they exert an upwardly directed force on the seating platform and exert a force on the rest carrier that pre-stresses the backrest toward the front.

The particular advantage of this chair is comprised therein that the compression spring arrangement requires only an extremely slight installation height, as a result whereof the component parts of the chair arranged under the seating platform, including the compression spring arrangement, can be implemented especially flat. As a result thereof, the side view of the chair is lent an especially elegant and light appearance without the stability and the functionality of the chair being deteriorated.

A further simplification of the design of the chair, as preferably provided, is achieved in that the spring section loaded for torsion simultaneously forms the first swivelling axis. A separate bearing pin for forming the swivelling axis is thereby eliminated, which advantageously reduces the number of discrete parts required.

It is also proposed that the spring levers of the spring section—as seen in a bottom view of the chair—proceed approximately parallel to one another and—as seen in a side view of the chair—proceed toward the back upon inclusion of an acute angle, whereby the second spring lever is supported at the upper side of the extension of the rest carrier and exerts a downwardly directed force on the extension. Given the fashioning and arrangement of the torsion bar spring described here, this also requires relatively little installation space in horizontal direction of the chair in the longitudinal direction thereof, so that a contribution to a compact structure is also made in this respect.

The torsion bar spring is preferably formed of one piece on the basis of a spring steel bar bent U-shaped. Such a torsion bar spring can be manufactured in an especially simple and cost-beneficial way and requires only slight material outlay, this contributing to a desired, low, overall weight of the chair.

In order to also achieve a distribution of the forces of the compression spring arrangement occurring upon use given this chair, it is also proposed that two torsion bar springs are provided symmetrically relative to the longitudinal center axis of the chair, these being preferably formed of one piece with one another on the basis as a single spring steel bar that is bent cam shaft-like.

The front and the back swivelling axis serve for connecting the seating platform to the seat carrier, to which end the seating platform usually comprises bearing supports at its underside. For all chairs implemented with bearing supports, the invention proposes that respectively two left and two right bearing supports are present, these being respectively implemented combined and of one piece to form a left and a right support component part or even to form a single support component part. This measure simplifies the manufacture of the chair and enhances the stability of the bearing of the seating platform at the seat carrier and at the rest carrier.

The invention also provides that the seat carrier and at least that part of the rest carrier proceeding under the seating platform as well as, potentially, the bearing supports are punched and pressed parts of sheet steel. Punched and pressed parts of sheet steel can be especially cost-beneficially fabricated in large unit numbers as mass-produced parts, whereby they exhibit high stability and durability at the same time. A high and also durable quality of the chair is thus assured given low manufacturing costs and given low wear.

As explained above, the chair preferably has a combination of synchronous mechanism and weight-dependent pre-stressing of the rest. For users who do not wish the synchronous mechanism, the chair can also be alternatively implemented such that the articulation of the seating platform to the rest carrier is omitted, as a result whereof the seating platform and the rest carrier can be swivelled unsynchronized, i.e., independently of one another. The technical modifications required for this purpose are advantageously limited to the omission of individual parts.

BRIEF DESCRIPTION OF THE DRAWINGS

A number of exemplary embodiments of the invention are explained below with reference to a drawing.

DETAILED DESCRIPTION OF THE PREFERRED EMBODIMENTS

Figure 1:
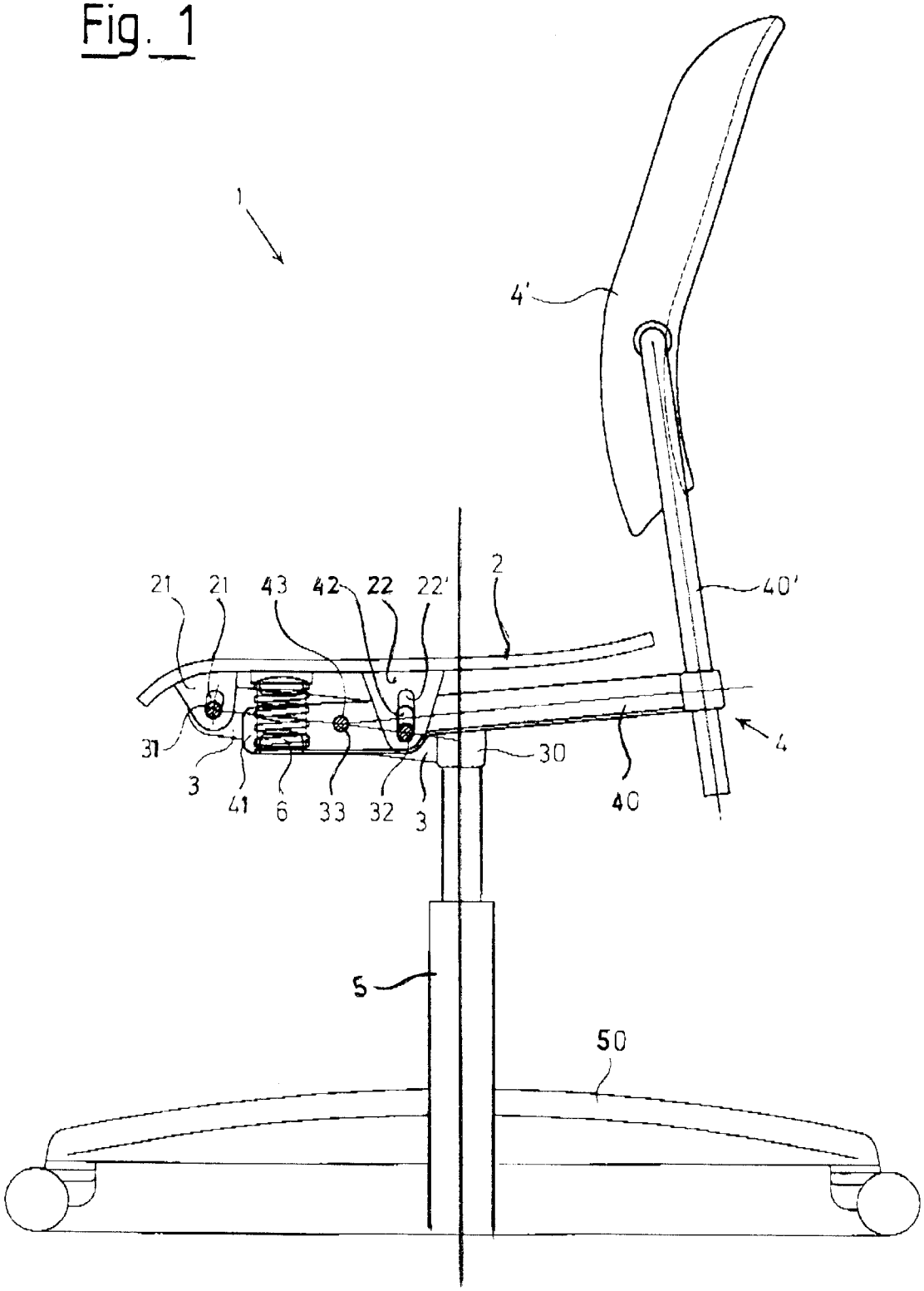
FIG. 1 shows a chair in a first embodiment as office swivel chair, in a side view.

As critical parts, the office swivel chair 1 shown in FIG. 1 as a first exemplary embodiment, has a seating platform 2, a seat carrier 3, a rest carrier 4 with a backrest 4' and a central chair column 5 with a foot cross 50 at its lower end.

The seating platform 2 is a plate that is stable in and of itself and that can be provided with a cushion (not shown here) at its upper side. At its underside, the seating platform 2 is connected to two front bearing supports 21 and two back bearing supports 22. The bearing supports 21, 22 of each support pair are arranged one behind the other in the side view shown in FIG. 1, so that respectively only one of the bearing supports 21, 22 is visible. The front bearing supports 21 are arranged close to the front edge of the seating platform 2 and each respectively have an oblong hole 21' through which a first bearing pin 31 proceeds horizontally and transversely. This first bearing pin 31 is rigidly connected to the seat carrier 3, which is in turn rigidly connected to the upper end of the central chair column 5 by means of a chair column receptacle 30.

The back, second bearing supports 22 likewise have a respective oblong hole 22' through which a second bearing pin 32 proceeds. This second bearing pin 32 is rigidly connected to the seat carrier 3 and proceeds parallel to the first bearing pin 31. The oblong hole 22' in the second bearing supports 22 thereby proceeds on a radius around the first, front bearing pin 31; the oblong hole 21' in the front bearing supports 21 proceeds on a radius around the second bearing pin 32. In this way, movement of the seating platform 2 is possible in vertical direction relative to the seat carrier 3, whereby this vertical movement can ensue both approximately on a straight line down as well as in the form of pivots around the first, front bearing pin 31 or around the second, back bearing pin 32.

In the illustrated exemplary embodiment, the rest carrier 4 carrying the backrest 4' is formed by two rest carrier parts 40, 40'. The rest carrier part 40 proceeds under the seating platform 2; at its back end, this is connected to the second rest carrier part 40' in the form of a plug-type connection that enables a height adjustment of the second rest carrier part 40' and of the backrest 4' secured thereto.

The first rest carrier part 40 proceeding under the seating platform 2 is pivotably seated with a bore 43 and a bearing pin 33, which is likewise rigidly connected to the seat carrier 3. The first rest carrier part 40 also comprises an extension 41 directed forward via the bearing pin 33 that proceeds parallel to the two other bearing pins 31 and 32.

Finally, the chair 1 also comprises a compression spring arrangement that is formed here by two coil compression springs 6. The springs 6 are arranged one behind the other in the side view, so that only one spring 6 is visible in FIG. 1. The coil compression spring 6 has its upper end supported at the underside of the seating platform 2, namely in a region between the front bearing support 21 and the back bearing supports 22. The coil compression spring 6 has its lower end supported at the forwardly directed extension 41 of the first rest carrier part 40, as a result whereof the coil compression spring exerts an upwardly directed pre-stressing force, on the one hand, on the seating platform 2 and, on the other hand, exerts a forwardly directed pre-stressing force on the backrest 4' via the first and the second rest carrier part 40, 40'.

The chair 1 is shown in a non-loaded condition in FIG. 1 wherein no forces are exerted on the seating platform 2 and on the backrest 4' by a user of the chair 1. The swivel position of the rest carrier 4 in this position is limited by a detent that is formed by an oblong hole 42 in the first rest carrier part 40. The second bearing pin 32 proceeds through this oblong hole 42, whereby the bearing pin 32 lies against the lower end of the oblong hole 42 here.

When the chair 1 is loaded by a user, the seating platform 2 moves down to a greater or lesser extent dependent on the body weight of the user. When the seating platform 2 is loaded by a heavier user, the spring arrangement 6 is more greatly compressed and is thereby lent higher tension. As a result thereof, the spring arrangement 6 exerts a greater force on the extension 41 of the first rest carrier part 40, which necessarily leads via lever action to the fact that the backrest 4' is lent a greater pre-stressing force toward the front, i.e., supports the user's back with a higher force. Given a lighter weight user of the chair 1, the seating platform 2 is pressed down correspondingly less, as a result whereof the spring arrangement is also tensed less and as a result whereof the backrest 4' then also experience a lower pre-stressing force. The pre-stressing force or supporting force of the backrest thus automatically adapts to users differing in weight.

The chair 1 also offers a synchronous mechanism that allows the position of the seating platform 2 and backrest 4' to be varied coupled to one another. When a user leans back on the chair 1, the seating platform 2 is lowered at the back, whereby the backrest 4' is simultaneously pivoted toward the back via the lever effects that thereby occur.

As is standard and known in and of itself, the backrest 4' can be additionally seated at the second rest carrier part 40' pivotable around a horizontally transversely proceeding axis, which enables a more improved adaptation of the backrest 4' to various users of the chair 1. The chair column 5 is likewise a known and standard design and is preferably height-adjustable as well as spring-mounted, so that, overall, the chair 1 offers versatile possibilities of adapting to different users, whereby the setting of the pre-stressing force of the backrest 4' advantageously ensues automatically dependent on the body weight of the user of the chair 1.

Figure 2:
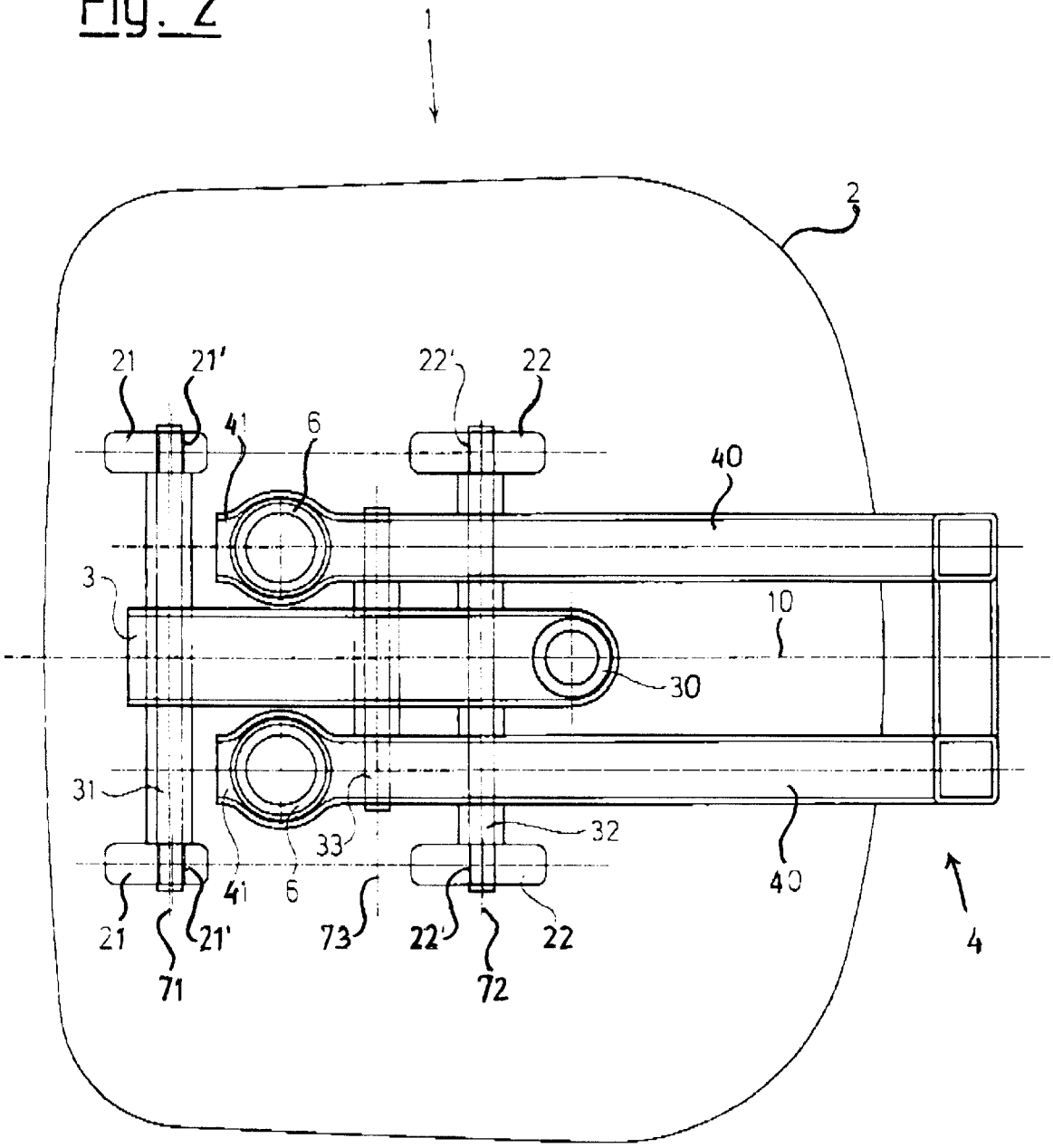
FIG. 2 shows the chair of FIG. 1 in a bottom view.

The bottom view of the chair 1 of FIG. 1 shown in FIG. 2 of the drawing illustrates the symmetrical arrangement of the mechanism of the chair 1 at both sides of the longitudinal center axis 10 of the chair. The seat carrier 3 lies in the middle, this having the chair column receptacle 30 at its back end (the right end in FIG. 2) for connection to the chair column 5 (not visible here). The three bearing pins 31, 32, 33 that proceed parallel to one another in transverse direction of the chair 1 under the seating platform 2 thereof are secured to the seat carrier 3 transverse thereto. The ends of the bearing pins 31 and 32 lie in the front and back bearing supports 21, 22 and proceed through the oblong holes 21', 22' shown in FIG. 1 that are provided therein.

FIG. 2 also shows that the first rest carrier part 40 is implemented bipartite with two parallel sections proceeding parallel to the longitudinal center axis 10. The two sections of the first rest carrier part 40 are pivotably seated at the third bearing pin 33; the extensions 41 of the two sections of the first rest carrier part 40 lie in front of the third bearing pin 33; i.e., to the left thereof in FIG. 2. The two coil compression springs 6 have their lower end, which face toward the observer here, supported on these extensions 41. The upper ends of the coil compression springs 6 facing away from the observer are supported at the underside of the seating platform 2 facing toward the observer.

It can be seen at the far right in FIG. 2 that the second rest carrier part 40' (not shown) can be connected here to the backrest 4" (not shown) by being plugged to the two sections of the first rest carrier part 40.

Overall, FIG. 2 illustrates the extremely compact structure of the mechanism of the chair 1, as a result whereof a simple manufacturability and a compact structure derive. The various swivelling axes 71, 72, 73 required for the movements of seating platform 2 and rest carrier 4 with the backrest 4' are formed by the bearing pins 31, 32, 33, whereby this design is both stable as well as low in wear.

Figure 3:
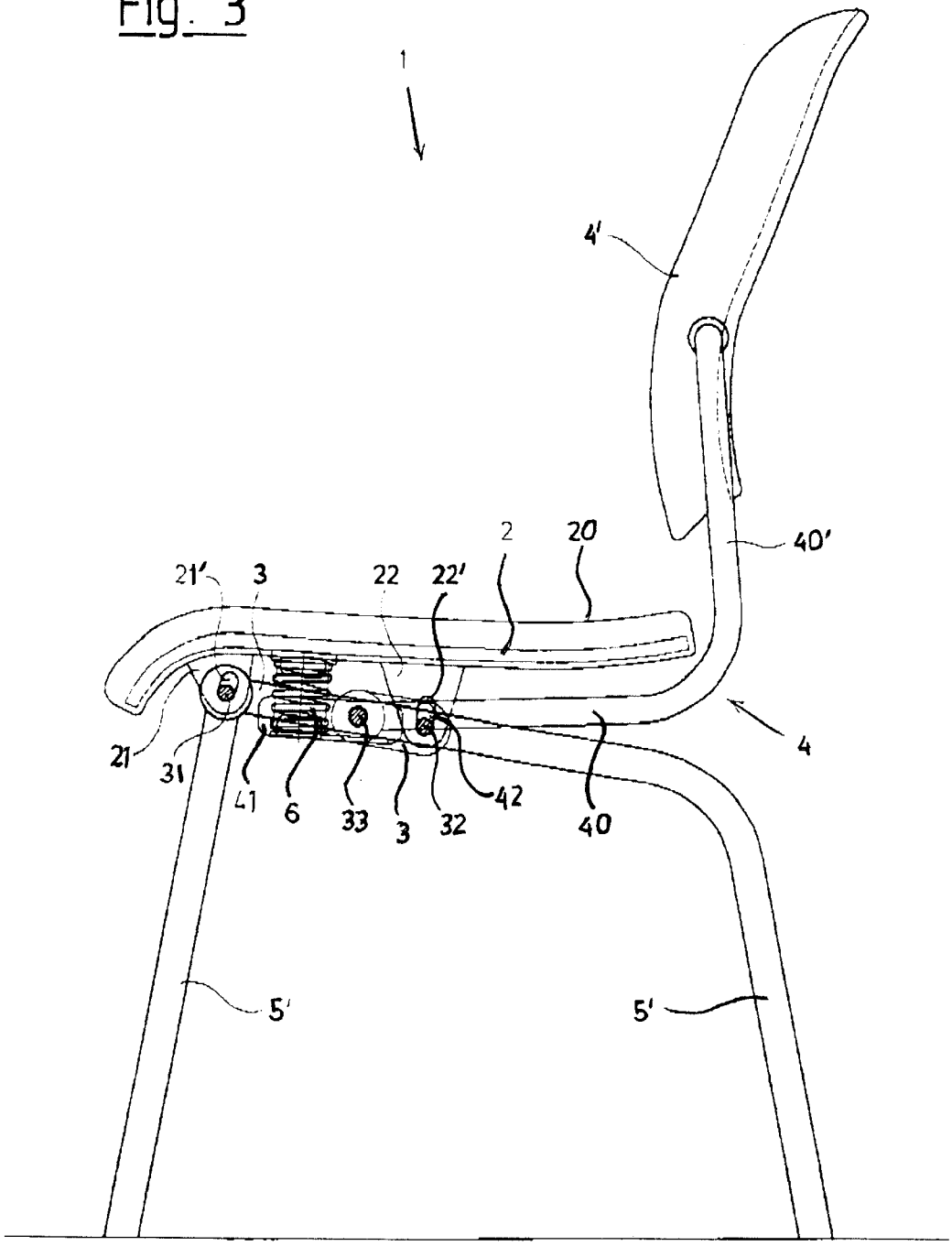
FIG. 3 shows the chair in a second embodiment as conference chair, likewise in a side view.

FIG. 3 of the drawing shows a conference or consultation chair 1 as a second exemplary embodiment that comprises four chair legs 5' instead of the central chair column, whereby only the respective chair legs 5' facing toward the viewer can be seen in the side view shown in FIG. 3.

This embodiment of the chair 1 also comprises an inherently stable seating platform 2 with a cushion 20, whereby the front and the back bearing supports 21, 22 with their oblong holes 21', 22' are again present here at the underside of the seating platform 2. The chair legs 5' are rigidly connected to one another via the seating platform 3. The three bearing pins 31, 32, 33 are also present here, these being in turn rigidly connected to the seat carrier 3.

The rest carrier 4 is implemented continuous here and again carries the backrest 4' at its upper part 40'. That part 40 of the rest carrier 4 lying under the seating platform 2 is seated at the seat carrier 3 pivotable around the bearing pin 33. Here, too, the second, back bearing pin 32 proceeds through an oblong hole 42 in the rest carrier part 40 in order to limit its swivel path.

Here, too, the rest carrier 4 comprises an extension 41 that proceeds toward the front via the swivelling axis 73. The compression spring arrangement 6 has its lower end supported on the extension 41, whereby the upper end thereof also lies against the underside of the seating platform 2 here.

With respect to the movements of seating platform 2 and rest carrier 4 with backrest 4', the chair 1 according to FIG. 3 behaves like the chair 1 according to FIGS. 1 and 2; here, too, an automatic adaptation of the pre-stressing force of the backrest 4' to the body weight of the user of the chair 1 thus ensues. Moreover, the synchronous mechanism for the coupled swivelling of seating platform 2 and rest carrier 4 with backrest 4' is also assured given the chair according to FIG. 3. The chair 1 according to FIG. 3 does not have an overall height adjustment as possible as a result of the chair column 5 given the chair 1 according to FIG. 1. A separate height adjustment of the backrest 4' is also not provided given the chair 1 according to FIG. 3. Since the individual parts of the chair 1 according to FIG. 3 can be simplified as a result thereof, the chair 1 of this embodiment can be especially cost-beneficially manufactured. At the same time, however, it offers the user great comfort due to the synchronous mechanism and due to the automatic adaptation of the pre-stressing force of the backrest 4' dependent on the body weight of the respective user. Since, moreover, the entire mechanism given the chair 1 according to FIG. 3 is very compact under the seating platform 2, this chair 1 can also be stacked for storage and transport purposes, as known from traditional, rigid chairs, as a result whereof an extremely space-saving arrangement derives.

Figure 4:
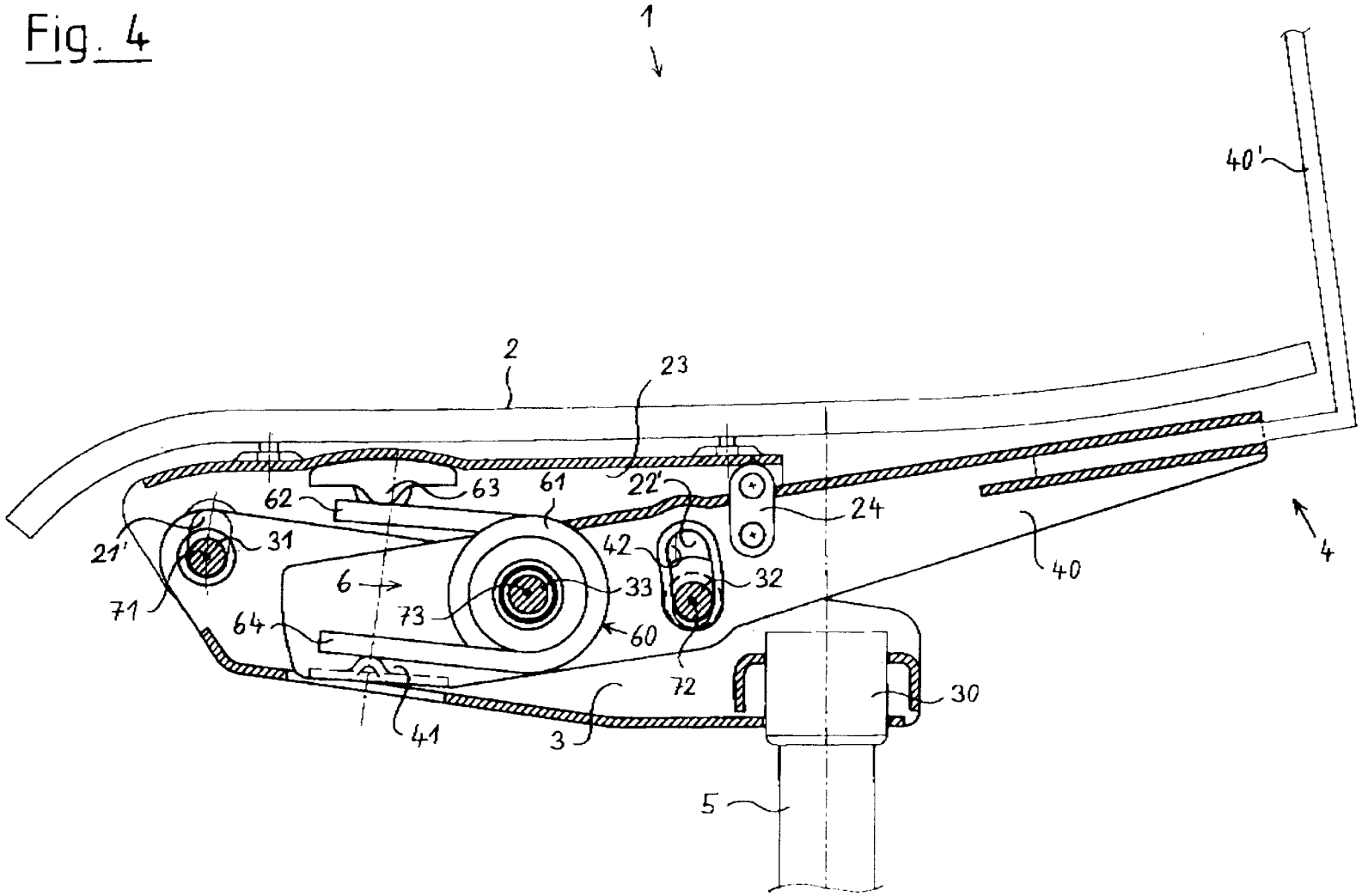
FIG. 4 shows the chair in a third embodiment in a partial side view, partly in vertical section.

The chair 1 shown in FIG. 4 as third exemplary embodiment is implemented as office swivel chair and its critical parts are a seating platform 2, a seat carrier 3, a rest carrier 4 for a backrest (not shown here) arranged farther up, a central chair column 5 with a foot cross (likewise not shown here) at its lower end, and a spring arrangement 6 between seating platform 2 and rest carrier 4.

The seating platform 2 is an inherently stable plate that can be provided with a cushion (not shown here) at its upper side. At its underside, the seating platform 2 is connected to a support component 23 having a respective left and right, downwardly directed cheek 23'. Close to the front edge of the seating platform 2 lying at the left in the drawing, the cheeks 23' of the support component 23 respectively comprise an oblong hole 21' through which a first bearing pin 31 proceeds horizontally and transversely. This first bearing pin 31 is rigidly connected to the seat carrier 3 that is in turn rigidly connected to the upper end of the central chair column 5 by means of a chair column receptacle 30 lying centrally under the seating platform 2.

Farther toward the back, here roughly centrally under the seating platform 2, the cheeks 23' of the support component 23 as well as the rest carrier 4 comprise further oblong holes 22', 42 through which a second bearing pin 32 proceeds. This second bearing pin 32 is also rigidly connected to the seat carrier 3 and proceeds parallel to the first bearing pin 31 offset down by about a pin thickness. The oblong hole 22' thereby respectively proceeds on a radius around the first bearing pin 31 in an essentially vertical direction, and the oblong hole 21' proceeds on a radius around the second bearing pin. In this way, a movement of the seating platform 2 is possible in vertical direction relative to the seat carrier 3, whereby this vertical motion can ensue both approximately on a straight line vertically as well as in the form of swivels around the first, front bearing pin 31 or around the second, back bearing pin 32.

In the illustrated exemplary embodiment, the rest carrier 4 is formed by two rest carrier parts 40, 40'. The rest carrier part 40 proceeds under the seating platform 2; at its back end, this is connected to the second rest carrier part 40' be a plug-type connection that enables an adjustment of the second rest carrier part 40' with the backrest secured thereto.

The first rest carrier part 40 proceeding under the seating platform 2 is pivotably seated at the seat carrier 3 by a third bearing pin 33 that is likewise rigidly connected to the seat carrier 3. Further, the first rest carrier part 40 comprises an extension 41 directed forward via the bearing pin 33 that proceeds parallel to the two other bearing pins 31, 32. Moreover, the support component 23 and the rest carrier part 40 are connected to one another in articulated fashion here via a dog 24 in the form of a short lever pivotally attached at each end in order to effect the synchronism of the swivel of seating platform 2 and backrest.

Finally, the chair 1 also comprises the spring arrangement 6 that is formed by two torsion springs 60 here. The torsion springs 60 are arranged one behind the other in the side view, so that only the one torsion spring 60 is visible in FIG. 4. The torsion spring 60 has a coiled spring member 61 that proceeds around the bearing pin 33 forming the third swivelling axis 73 and is held thereon with a holder that has not been numbered. A respective upper spring leg 62 and a lower spring leg 64 proceed tangentially from the spring member 61 toward the front roughly parallel to one another. Close to its free end, the first, upper spring leg 62 of the torsion spring 60 is supported at the underside of the seating platform 2, namely in a region between the bearing pins 31 and 33. To reduce wear and noise, a pressure member 63 is provided here as part of the support component 23, this being attached to the underside of the seating platform 2. The spring legs 62 lie against the pressure member 63. The torsion spring 60 has its second, lower spring leg 64 supported at the forwardly directed extension 41 of the first rest carrier part 40, as a result whereof, on the one hand, the spring leg 60 exerts an upwardly directed pre-stressing force onto the seating platform 2 and, on the other hand, exerts a forwardly directed pre-stressing force on the backrest via the first and the second rest carrier part 40, 40'.

FIG. 4 shows the chair 1 in a non-loaded condition wherein no forces are exerted on the seating platform 2 and on the backrest and its rest carrier parts 40, 40' by a user of the chair 1. The swivelled position of the rest carrier 4 is limited in this position by a detent that is formed by the oblong hole 42 in the first rest carrier part 40. The second bearing pin 32 proceeds through this oblong hole 42, whereby the bearing pin 32 lies against the lower end of the oblong hole 42 here.

When the chair 1 is loaded by a user, the seating platform 2 moves down to a greater or lesser extent dependent on the body weight of the user. When the seating platform 2 is loaded by a heavier user, the spring legs 62, 64 of the torsion springs to are more greatly compressed, and the torsion springs 60 are thereby lent a higher tension. As a result thereof, the springs 60 also exert a greater force onto the extension 41 of the first rest carrier part 40, which, via the lever effect, necessarily leads thereto that the backrest is lent a higher pre-stressing force toward the front, i.e. supports the user's back with a higher force. Given a lighter weight user of the chair 1, the seating platform 2 is pressed down correspondingly less, as a result whereof the springs 60 are also tensed to a lesser extent, and as a result whereof the backrest also experiences less of a pre-stressing force. The pre-stressing or supporting force of the backrest thus automatically adapts to users differing in weight.

The chair 1 also offers a synchronous mechanism that sees to it that, when the chair 1 is used, the positions of seating platform 2 and backrest 4' change coupled with one another. When a user leans back on the chair 1, the seating platform 2 is more highly loaded at the back and lowers there, whereby, via the dog 24, the backrest is simultaneously swivelled toward the back in a fixed swivel relationship via the lever effects that thereby occur. When the synchronous mechanism is not desired, this can be eliminated simply by omitting the dog 24.

As is known in and of itself and standard, the backrest can be additionally seated at the second rest carrier part 40' pivotable around a horizontally transversely proceeding axis, which enables a further improved adaptation of the backrest to various users of the chair 1. The chair column 5 likewise has a known and standard design and is preferably height-adjustable as well as spring mounted, so that, overall, the chair 1 offers versatile adaptation possibilities to different users. The setting of the pre-stressing force of the backrest thereby advantageously ensues automatically dependent on the body weight of the user of the chair 1, so that manual adjustments are not necessary therefor.

Figure 5:
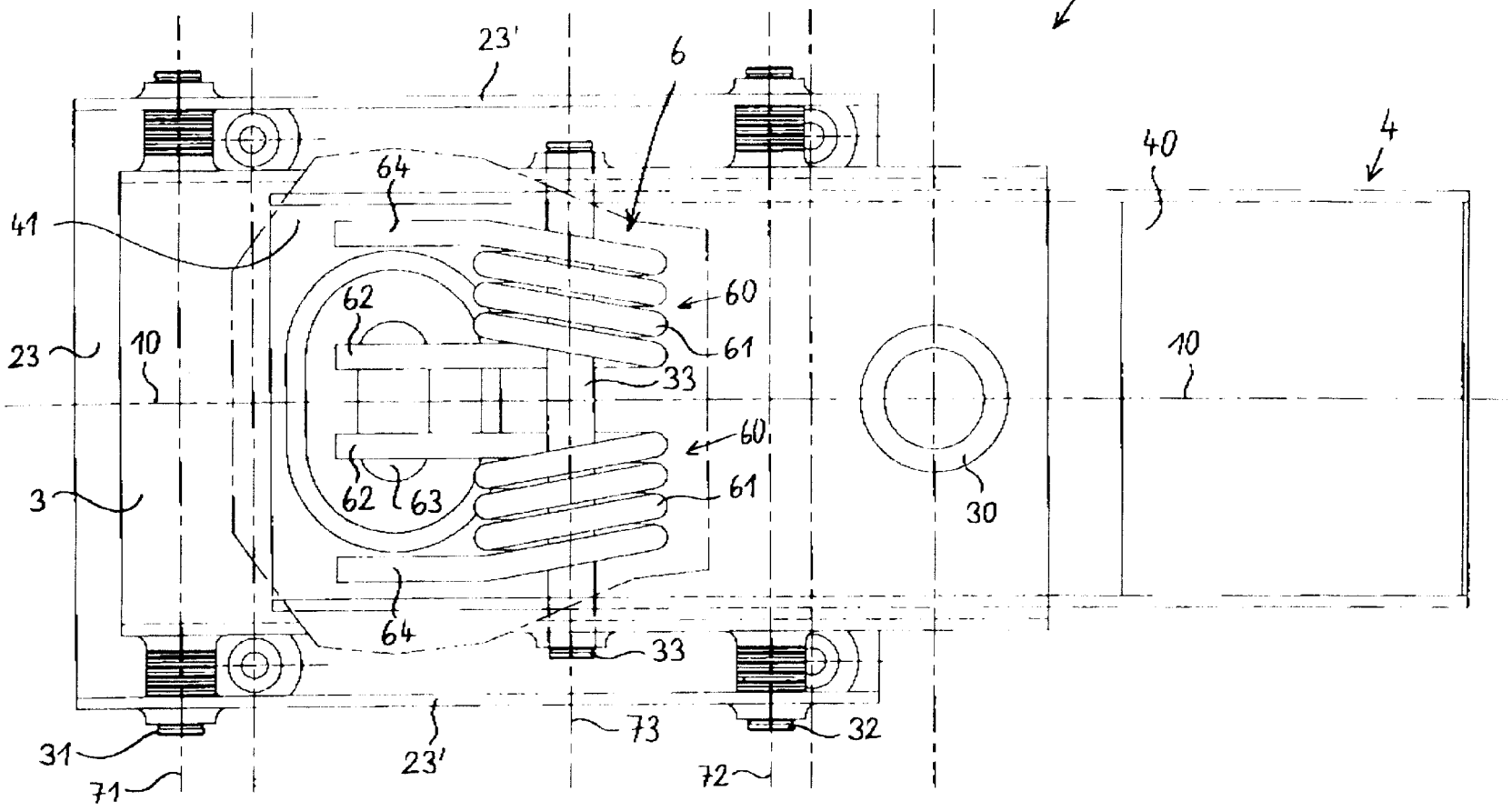
FIG. 5 shows the chair of FIG. 4 in a bottom view.

The bottom view of the chair of FIG. 4 shown in FIG. 5 of the drawing illustrates the symmetrical arrangement of the mechanism of the chair 1 at both sides of the longitudinal center axis 10 of the chair. The seat carrier 3, which comprises the chair column receptacle 30 for connection to the chair column 5 (not visible here) at its back, right-hand end in FIG. 5, lies in the middle. The three bearing pins 31, 32, 33 that proceed parallel to one another in transverse direction of the chair 1 under the seating platform 2 thereof (which is not shown here) are secured to the seat carrier 3 transverse thereto. The ends of the bearing pins 31 and 32 lie in the two lateral cheeks 23' of the support component 23 and proceed through the oblong holes 21', 22' provided therein that are shown in FIG. 4.

FIG. 5 also shows that the first back carrier part 40 is implemented of one piece as a flat strip with two parallel, lateral flanges that proceed parallel to the longitudinal center axis 10. The first rest carrier part 40 is pivotably seated at the third bearing pin 33; the extension 41 of the first rest carrier part 40 lies in front of the third bearing pin, i.e. to the left thereof in FIG. 5. The two torsion springs 60 have their spring legs 64 supported on this extension 41. The torsion springs 60 have their spring legs 62 supported at the underside (facing toward the viewer) of the seating platform 2 (not shown) that lies in the background here.

It can be seen at the far right in FIG. 5 that the second rest carrier part 40' (not shown here) can be connected to the backrest by plugging to the first rest carrier part 40.

Overall, FIG. 5 illustrates the extremely compact structure of the mechanism of the chair 1, as a result whereof a simple manufacturability and a "light" appearance of the chair 1 derive. The three swivelling axes 71, 72, 73 required for the movements of seating platform 2 and rest carrier 4 with the backrest are formed by the bearing pins 31, 32, 33, whereby this design is both stable as well as low in wear.

Figure 6:
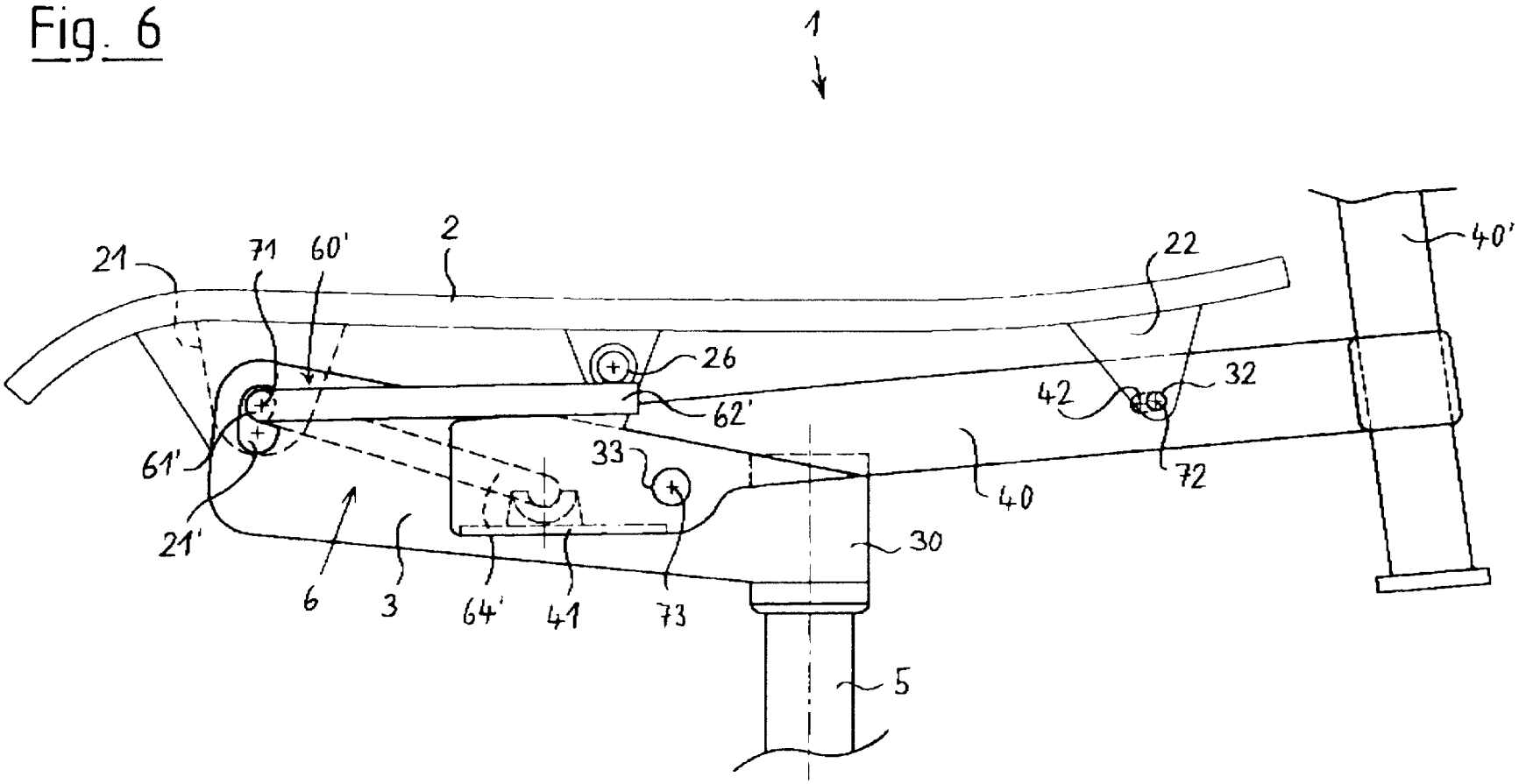
FIG. 6 shows the chair in a fourth embodiment in a partial side view.
Figure 7:
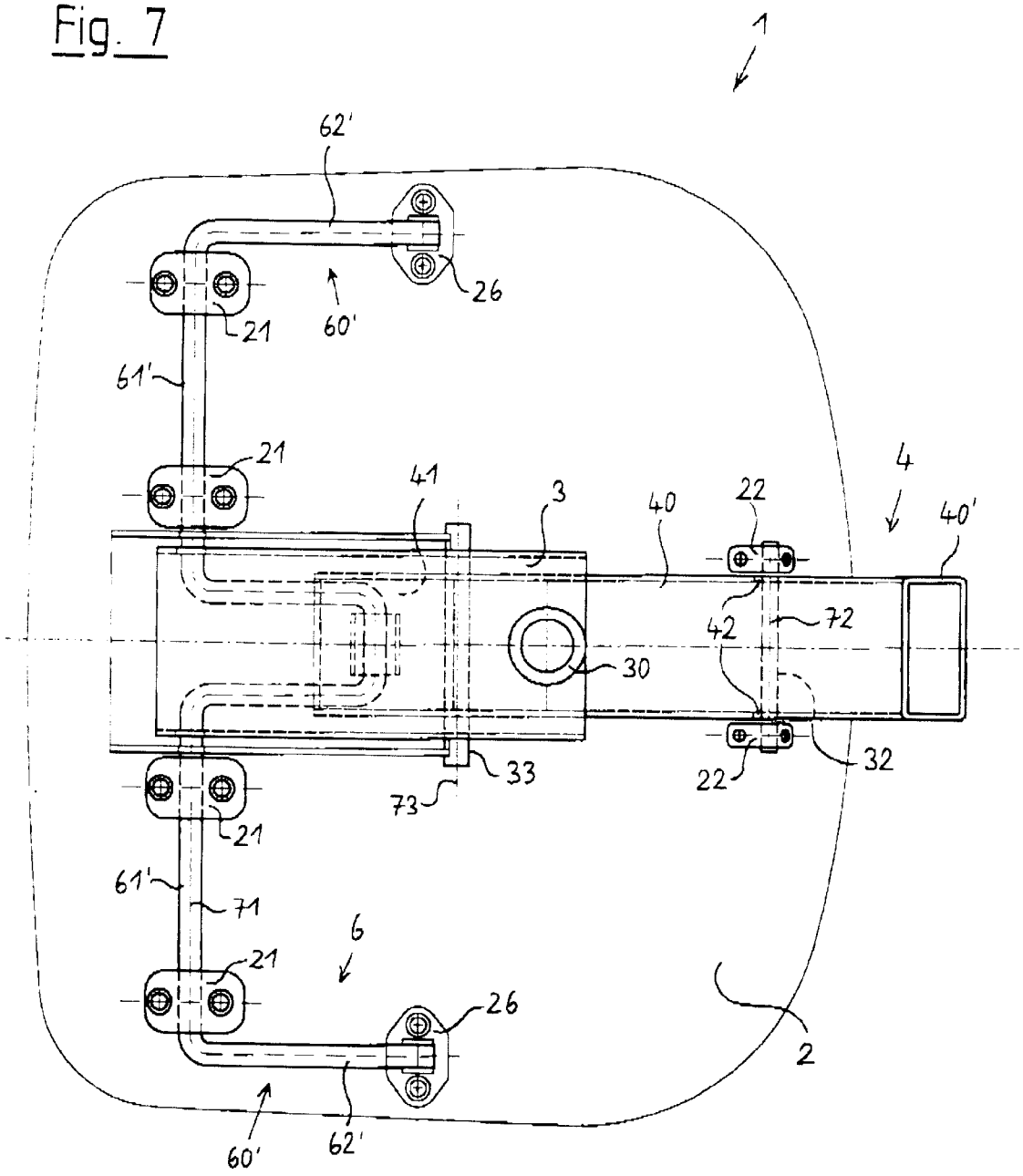
FIG. 7 shows the chair of FIG. 6 in a bottom view.

FIGS. 6 and 7 of the drawing show a further office swivel chair 1 as a fourth exemplary embodiment that likewise comprises a central chair column 5, whereby only the upper end of the chair column that is connected to that end of the seat carrier 3 lying centrally under the seating platform 2 can be seen in the partial side view shown in FIG. 6.

This embodiment of the chair 1 also comprises an inherently stable seating platform 2, whereby front bearing supports 21 each having a respective, vertical oblong hole 21' and back bearing supports 22 are present at the underside thereof respectively separated from one another. Differing from the first exemplary embodiment, however, only two bearing pins 32, 33 are present here, the pin 33 thereof being rigidly connected to the seat carrier 3, whereas the pin 32 is fixed in the bearing support 22.

The rest carrier 4 is also implemented bipartite here and carries the backrest (not shown) at its upper part 40'. That part 40 of the rest carrier 4 lying under the seating platform 2 is seated at the seat carrier 3 pivotable around the swivelling axis 73 by means of the bearing pin 33. Here, too, the second, back bearing pin 32 proceeds through an oblong hole 42 in the rest carrier part 40, whereby the oblong hole 42 here proceeds through the rest carrier part 40 in longitudinal direction thereof in order to enable the force-free swivelling thereof.

Here, too, the rest carrier 4 comprises an extension 41 of one piece with the rest carrier part 40 that proceeds toward the front via the swivelling axis 73.

A torsion bar spring 60' is installed here as spring element 6. This spring 60' has two spring sections 61' stressed for torsion that proceed in transverse chair direction through the oblong holes 21' and simultaneously serve as first swivelling axis 71. At the outside left and right, a respective spring lever 62' extends toward the back from the spring section 61' and lies against a respective detent 26 that is respectively attached to the underside of the seating platform 2. Two further spring levers 64' that likewise proceed in the direction toward the back and that are supported on the extension 41 of the rest carrier part 40 in a region connecting their free ends lie in the region between the spring sections 61'. The spring 60' shown here is implemented as symmetrical double spring and is manufactured of one piece from a correspondingly bent spring steel bar. The torsion bar spring 60' is pre-stressed such that its spring levers 62', 64' exert the desired, upwardly directed force onto the seating platform 2 and the desired, downwardly directed force onto the extension 41, as indicated by the arrows at the spring levers 62', 64'.

With respect to the movements of seating platform 2 and rest carrier 4 with backrest, the chair 1 according to FIGS. 6 and 7 behaves like the chair 1 according to FIG. 4 and 5; here, too, an automatic adaptation of the pre-stressing force of the backrest to the body weight of the user of the chair 1 thus ensues. Moreover, the synchronous mechanism for coupled swivelling of seating platform 2 and rest carrier 4 with backrest is also assured given the chair 1 according to FIGS. 6 and 7.

The chair 1 according to FIGS. 6 and 7 can also have an overall height adjustment as possible with the chair column 5 given the chair 1 according to FIGS. 4 and 5. A separate height adjustment of the backrest can also be provided given the chair 1 according to FIGS. 6 and 7.

It is especially advantageous that the entire mechanism given the chair 1 according to FIGS. 6 and 7 is very compact under the seating platform 2 and occupies only little structural height and that only few discrete parts are required.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

What is claimed is:

1. A chair comprising:

a seating platform having a front edge and a back edge, a seat carrier that carries the seating platform and is connected to one of a central chair column and a plurality of chair legs, a rest carrier that proceeds toward the back under the seating platform and upward behind the seating platform, a backrest carried on the rest carrier, the seating platform, close to its front edge, is hinged to the seat carrier pivotable around a transversely proceeding, first swivelling axis and, offset therefrom toward the back edge, is hinged to the rest carrier pivotable around a parallel, second swivelling axis, the rest carrier is hinged to the seat carrier pivotable around a third swivelling axis that is located between the first and second swivelling axis and parallel thereto, a spring provided under the seating platform and supported thereat which exerts a pre-stress force acting upwardly on the seating platform and toward the front on the back rest, the rest carrier comprises an extension that forms a lever arm that extends forward of the third swivelling axis;

the spring has its end remote from the seating platform supported on the rest carrier extension; and the seating platform comprises a vertical motion latitude relative to at least one of the seat carrier and the rest carrier.

2. A chair according to claim 1, wherein the second swivelling axis is located under and close to a longitudinal center of the seating platform.

3. A chair according to claim 1, wherein the seating platform comprises at least one respective front and back bearing support at its underside through which the first, front and the second, back swivelling axis proceeds.

4. A chair according to claim 3, wherein the bearing supports each comprise a respective oblong hole through which a first, front and second, back bearing pin, rigidly connected to the seat carrier, respectively proceeds, whereby a front oblong hole extends on a radius around the back bearing pin and a back oblong hole extends on a radius around the front bearing pin.

5. A chair according to claim 4, wherein, for forming a motion detent for the rest carrier, the second, back bearing pin also extends through an essentially vertically directed oblong hole in the rest carrier.

6. A chair according to claim 4, wherein the seat carrier, proceeding in longitudinal direction of the seating platform, is arranged thereunder in a transverse center thereof and is connected to the chair column at its back end; and that a respective rest carrier having a respective, appertaining spring is provided to the left and right of the seat carrier symmetrically thereto; in that two respective, front and back bearing supports are present; and in that a respective through, front and back bearing pin is attached to the seat carrier.

7. A chair according to claim 4, wherein the seat carrier is implemented bipartite and, proceeding in longitudinal direction of the seating platform, is arranged laterally thereunder to the left and right and also has its front and back ends connected to a respective chair leg; a respective rest carrier with a respective, appertaining compression spring arrangement is provided at the left and right inside of the two seat carrier parts and parallel thereto; two respective front and back bearing supports are present; and a respective, through, front and back bearing pin is attached to the two seat carrier parts.

8. A chair according to claim 1, wherein the spring is a coil spring.

9. A chair according to claim 1, wherein the spring is one of a gas compression spring and an elastomer spring.

10. A chair according to claim 1, wherein the spring is a torsion spring.

11. A chair according to claim 10, wherein each torsion spring comprises a spring member that comprises one or more turns surrounding the third swivelling axis as well as two spring legs extending tangentially outward therefrom, whereby a first spring leg is supported close to its free end at an underside of the seating platform and a second spring leg is supported at the rest carrier, and whereby the spring legs are biased such that they exert an upwardly directed force onto the seating platform and exert a force on the rest carrier that pre-stresses the backrest toward the front.

12. A chair according to claim 11, wherein both spring legs proceed toward the front away from the spring member approximately parallel to one another, whereby the second spring leg is supported at the upper side of the extension of the rest carrier and exerts a downwardly directed force onto the extension.

13. A chair according to claim 11, wherein at least the first spring leg lies in one of a glide and roller guidance connected to the seating platform.

14. A chair according to claim 11, wherein torsion springs are provided symmetrically relative to the longitudinal center axis of the chair, these being formed of one piece with one another on the basis of a single, correspondingly doubly coiled and bent spring steel rod.

15. A chair according to claim 1, wherein the spring is formed by at least one torsion bar spring.

16. A chair according to claim 15, wherein each torsion bar spring forming the spring is formed with at least one spring section that is loaded for torsion and proceeds in a transverse chair direction and is formed with at least two spring levers proceeding in longitudinal chair direction, whereby a first spring lever is supported close to its free end at the underside of the seating platform and a second spring lever is supported at the rest carrier, and whereby the spring levers are biased such that they exert an upwardly directed force on the seating platform and exert a force on the rest carrier that pre-stresses the backrest toward the front.

17. A chair according to claim 16, wherein the spring section of the torsion bar spring simultaneously forms the first swivelling axis.

18. A chair according to claim 16, wherein the spring levers of the spring section, as seen in a bottom view of the chair, proceed approximately parallel to one another and, as seen in a side view of the chair, proceed toward the back upon inclusion of an acute angle, whereby the second spring lever is supported at the upper side of the extension of the rest carrier and exerts a downwardly directed force on the extension.

19. A chair according to claim 16, wherein the torsion bar spring is formed of one piece by a spring steel bar bent U-shaped.

20. A chair according to claim 16, wherein two torsion bar springs are provided symmetrically relative to a longitudinal center axis of the chair, these being preferably formed of one piece with one another on the basis of a single spring steel bar that is bent camshaft-like.

21. A chair according to claim 1, wherein the seating platform comprises bearing supports at the underside through which the first, front and the second, back swivelling axis proceed, wherein respectively two left and two right bearing supports are present, these being respectively implemented in a combined form of no more than one piece forming a left support component part and one piece forming a right support component part.

22. A chair according to claim 21, wherein the left support component part and the right support component part are implemented in a single combined piece.

23. A chair according to claim 1, wherein the seat carrier and at least that part of the rest carrier proceeding under the seating platform are punched and pressed parts of sheet steel.

24. A chair according to claim 1, wherein an articulation of the seating platform to the rest carrier is omitted and the seating platform and the rest carrier are pivotable unsynchronized and independently of one another.

* * * * *